US009685737B2

(12) United States Patent
Tsai et al.

(10) Patent No.: US 9,685,737 B2
(45) Date of Patent: Jun. 20, 2017

(54) STANDING-TYPE ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Rui Su, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/065,139

(22) Filed: Mar. 9, 2016

(65) Prior Publication Data

US 2016/0268741 A1 Sep. 15, 2016

(30) Foreign Application Priority Data

Mar. 9, 2015 (CN) ..... 2015 1 0101890

(51) Int. Cl.

| | |
|---|---|
| ***H01R 13/6585*** | (2011.01) |
| ***H01R 12/71*** | (2011.01) |
| ***H01R 13/6595*** | (2011.01) |
| *H01R 13/6596* | (2011.01) |
| *H01R 24/60* | (2011.01) |
| *H01R 107/00* | (2006.01) |

(52) U.S. Cl.

CPC ..... *H01R 13/6585* (2013.01); *H01R 12/716* (2013.01); *H01R 13/6595* (2013.01); *H01R 13/6596* (2013.01); *H01R 24/60* (2013.01); *H01R 2107/00* (2013.01)

(58) Field of Classification Search

USPC ..... 439/607.05, 78, 271, 660, 607.39, 108

See application file for complete search history.

(56) References Cited

U.S. PATENT DOCUMENTS

| | | | | |
|---|---|---|---|---|
| 6,402,554 | B1 * | 6/2002 | Yeh | H01R 13/6594 439/607.39 |
| 6,500,013 | B1 * | 12/2002 | Wang | H01R 12/598 439/108 |
| D476,956 | S * | 7/2003 | Sukegawa | D13/147 |
| D516,519 | S * | 3/2006 | Nishio | D13/147 |
| D517,491 | S * | 3/2006 | Nishio | D13/147 |
| 8,641,455 | B2 * | 2/2014 | Lan | H01R 12/51 439/660 |

(Continued)

*Primary Examiner* — Alexander Gilman

(74) *Attorney, Agent, or Firm* — Muncy, Geissler, Olds & Lowe, P.C.

(57) ABSTRACT

A standing-type electrical receptacle connector includes a metallic shell, an insulated housing, and an outer shell. The metallic shell defines a receiving cavity therein. The insulated housing is received in the receiving cavity and includes a base portion and a tongue portion extending from one side of the base portion. The outer shell includes a sleeve enclosing the metallic shell, two or more extending sheets respectively extending from two sides of the sleeve, and two or more positioning portions at the extending sheets. The extending sheets are abutted against a circuit board. The circuit board defines positioning holes positioned with the positioning portions.

14 Claims, 8 Drawing Sheets

(56) References Cited

U.S. PATENT DOCUMENTS

| | | | | |
|---|---|---|---|---|
| 8,944,829 | B2 * | 2/2015 | Ho | H01R 13/04 439/79 |
| 9,413,123 | B2 * | 8/2016 | Kao | H01R 13/2442 |
| 9,425,559 | B2 * | 8/2016 | Kao | H01R 13/6585 |
| 9,444,177 | B2 * | 9/2016 | Tsai | H01R 13/5202 |
| 9,461,413 | B2 * | 10/2016 | Duan | H01R 13/6594 |
| 9,478,915 | B2 * | 10/2016 | Guo | H01R 13/6585 |
| 9,484,662 | B2 * | 11/2016 | Guo | H01R 13/504 |
| 9,484,679 | B2 * | 11/2016 | Guo | H01R 13/6585 |
| 9,490,594 | B2 * | 11/2016 | Little | H01R 24/60 |
| 9,496,653 | B2 * | 11/2016 | Little | H01R 13/6582 |
| 2003/0220014 | A1 * | 11/2003 | Ko | H01R 12/775 439/579 |
| 2011/0263141 | A1 * | 10/2011 | Ko | H01R 12/707 439/83 |
| 2012/0315779 | A1 * | 12/2012 | Yudate | H01R 12/724 439/271 |
| 2013/0065442 | A1 * | 3/2013 | Nagata | H01R 13/5202 439/607.58 |
| 2013/0183844 | A1 * | 7/2013 | Wang | H01R 24/68 439/271 |
| 2015/0236441 | A1 * | 8/2015 | Kim | H01R 24/76 439/587 |
| 2016/0104957 | A1 * | 4/2016 | Kim | H01R 13/6581 439/78 |

* cited by examiner

100

| | | | | | | | | | | | | | | | | | |
|---|---|---|---|---|---|---|---|---|---|---|---|---|---|---|---|---|---|
| GND | TX1+ | TX1− | VBUS | CC1 | D+ | D− | RFU | VBUS | RX2− | RX2+ | GND | 4 |
| GND | RX1+ | RX1− | VBUS | RFU | D− | D+ | CC2 | VBUS | TX2− | TX2+ | GND | 5 |

Fig. 6

STANDING-TYPE ELECTRICAL RECEPTACLE CONNECTOR

CROSS-REFERENCES TO RELATED APPLICATIONS

This non-provisional application claims priority under 35 U.S.C. §119(a) on Patent Application No. 201510101890.X filed in China, P.R.C. on Mar. 9, 2015, the entire contents of which are hereby incorporated by reference.

FIELD OF THE INVENTION

The instant disclosure relates to an electrical receptacle connector, and more particular to a standing-type electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, micro USB interconnects are developed which include advantageous like small occupation volume and ease of portability. Therefore, the micro USB interconnects are widely adopted to smart mobile devices, digital cameras, or other portable electronic devices to mate with connecting cables for data transmission or power supply.

A conventional standing-type electrical receptacle connector having USB Type-C connection interface includes an insulated housing, a plurality of first terminals, a plurality of second terminals, and a hollowed shell. The insulated housing includes a base portion and a tongue portion extending from one side of the base portion. Each of the first terminals is held in the base portion and the tongue portion. The front of each of the first terminals is disposed at an upper surface of the tongue portion, and the rear of each of the first terminals is protruded from the base portion and soldered with a circuit board. Each of the second terminals is held in the base portion and the tongue portion. The front portion of each of the second terminals is disposed at a lower surface of the tongue portion, and the rear of each of the second terminals is protruded from the base portion and soldered with the circuit board. The hollowed shell encloses the base portion and the tongue portion.

However, the standing-type electrical receptacle connector is positioned with the circuit board only by the rear of the terminals soldered with the circuit board. Therefore, when the standing-type electrical receptacle connector suffers an impact force, the connector would be detached off the circuit board easily.

SUMMARY OF THE INVENTION

Consequently, how to improve the existing connector becomes an issue.

In view of this, an embodiment of the instant disclosure provides a standing-type electrical receptacle connector which can be stably positioned with a circuit board. Accordingly, the aforementioned problems can be improved.

An embodiment of the instant disclosure provides a standing-type electrical receptacle connector comprising a metallic shell, an insulated housing, a plurality of upper-row receptacle terminals, a plurality of lower-row receptacle terminals, and an outer shell. The metallic shell defines a receiving cavity therein. The insulated housing is received in the receiving cavity and comprises a base portion and a tongue portion extending from one side of the base portion. The tongue portion has an upper surface and a lower surface opposite to the upper surface. The upper-row receptacle terminals comprise a plurality of upper signal pairs, at least one power terminal, and at least one ground terminal. Each of the upper-row receptacle terminals is held in the insulated housing and disposed at the upper surface. The lower-row receptacle terminals comprise a plurality of lower signal pairs, at least one power terminal, and at least one ground terminal. Each of the lower-row receptacle terminals is held in the insulated housing and disposed at the lower surface. The outer shell comprises a sleeve, at least two extending sheets, and at least two positioning portions. The sleeve encloses the metallic shell. The two extending sheets are respectively extending from two sides of the sleeve. The positioning portions are at the extending sheets.

In some embodiments, the insulated housing comprises an upper base and a lower base. The upper base and the lower base are extending out of the metallic shell. The outer shell comprises a covering plate at the rear of the sleeve to cover the upper base and the lower base.

In some embodiments, each of the positioning portions comprises at least one leg extending outward from the side portion of the covering plate.

In some embodiments, each of the positioning portions comprises a lock hole formed on the covering plate.

In some embodiments, each of the positioning portions comprises at least one leg extending outward from the side portion of the covering plate and a lock hole formed on the covering plate.

In some embodiments, the standing-type electrical receptacle connector further comprises a circuit board assembled on the base portion. Each of the extending sheets is abutted against the circuit board. The circuit board comprises at least two positioning holes respectively positioned with the positioning portions.

In some embodiments, the insulated housing comprises at least one extending portion extending outward from one side of the base portion, and the extending portion defines a through hole corresponding to one of the positioning holes.

In some embodiments, the upper-row receptacle terminals and the lower-row receptacle terminals have 180 degree symmetrical design with respect to a central point of the receiving cavity as the symmetrical center.

In some embodiments, the position of the upper-row receptacle terminals corresponds to the position of the lower-row receptacle terminals.

In some embodiments, each of the upper-row receptacle terminals comprises a flat contact portion, a body portion, and a tail portion. The body portion is held in the base portion and disposed at the upper surface of the tongue portion. The flat contact portion is extending forward from the body portion in the rear-to-front direction and partly exposed upon the upper surface of the tongue portion. The tail portion is extending backward from the body portion in the front-to-rear direction and protruded from the base portion.

In some embodiments, each of the lower-row receptacle terminals comprises a flat contact portion, a body portion, and a tail portion. The body portion is held in the base portion and disposed at the lower surface of the tongue portion. The flat contact portion is extending forward from the body portion in the rear-to-front direction and partly exposed upon the upper surface of the tongue portion. The tail portion is extending backward from the body portion in the front-to-rear direction and protruded from the base portion.

In some embodiments, the standing-type electrical receptacle connector further comprises a grounding plate disposed at the insulated housing and between the upper-row receptacle terminals and the lower-row receptacle terminals.

Based on the above, the outer shell is fitted over the metallic shell and comprises two extending sheets extending therefrom for improving the positioning stability between the standing-type electrical receptacle connector and the circuit board, by the way that the two extending sheets allow the standing-type electrical receptacle connector to be firmly positioned with the circuit board after the standing-type electrical receptacle connector is soldered with the circuit board. In addition, the extending sheet comprises a positioning portion corresponding to the positioning hole of the circuit board. The positioning portion may be a leg inserted into the positioning hole or may be a lock hole allowing a bolt or a threadable component to pass through and to further lock with the positioning hole of the circuit board. Hence, the standing-type electrical receptacle connector can be stably positioned with the circuit board, and the overall structural strength between the connector and the circuit board can be improved. In addition, because the metallic shell and the outer shell are separate pieces, the manufacturing of the connector can be simplified and the overall strength of the connector can be improved.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the standing-type electrical receptacle connector can have a 180 degree symmetrical, dual or double orientation design and pin assignments which enables the standing-type electrical receptacle connector to be mated with a corresponding plug connector in either of two intuitive orientations, i.e. in either upside-up or upside-down directions. Therefore, when an electrical plug connector is inserted into the standing-type electrical receptacle connector with a first orientation, the flat contact portions of the upper-row receptacle terminals are in contact with upper-row plug terminals of the electrical plug connector. Conversely, when the electrical plug connector is inserted into the standing-type electrical receptacle connector with a second orientation, the flat contact portions of the lower-row receptacle terminals are in contact with the upper-row plug terminals of the electrical plug connector. Note that, the inserting orientation of the electrical plug connector is not limited by the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 6 illustrates a schematic configuration diagram of the receptacle terminals of the electrical receptacle connector shown in FIG. 5;

DETAILED DESCRIPTION

Figure 1:
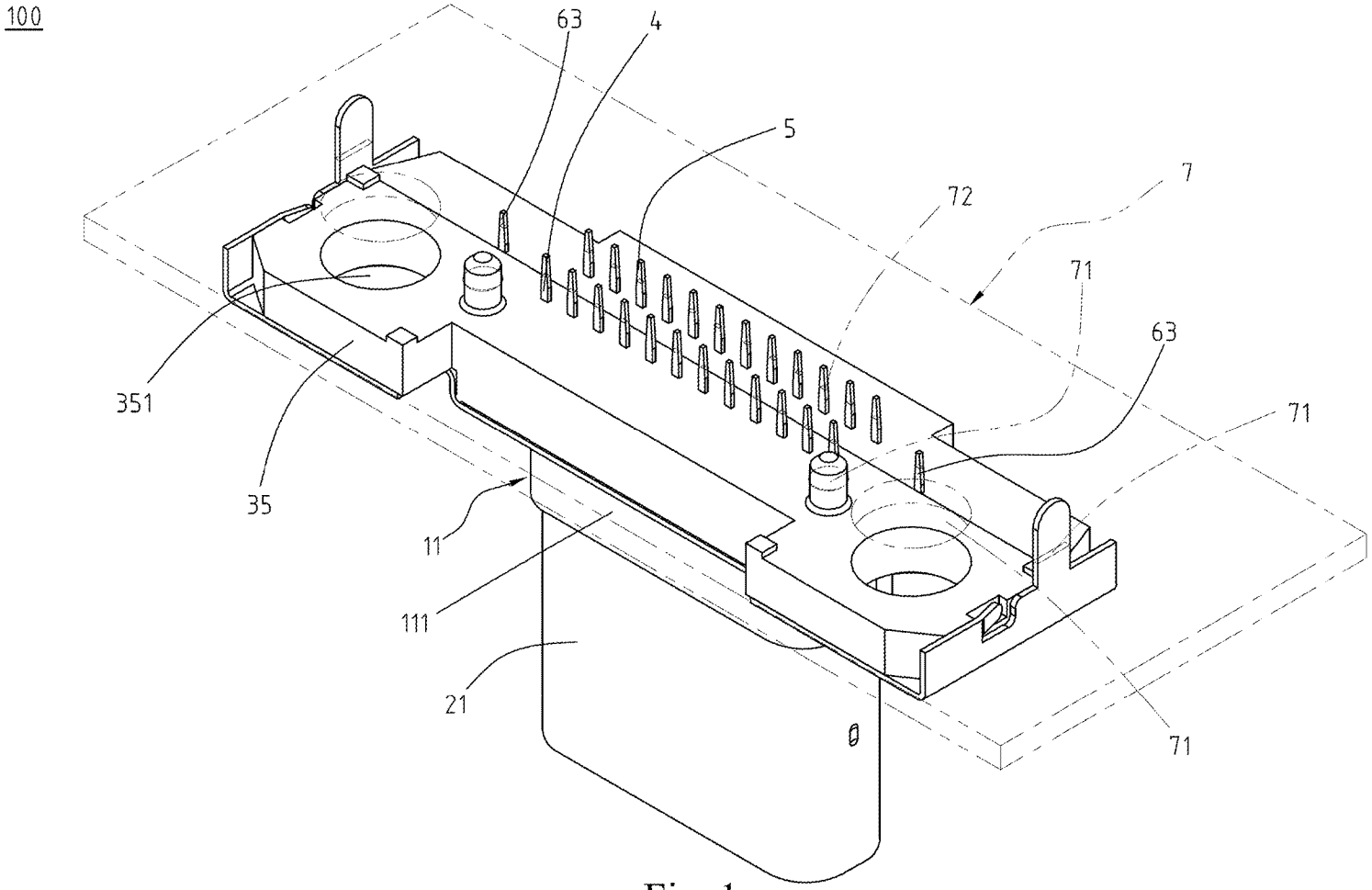
FIG. 1 illustrates a perspective view of a standing-type electrical receptacle connector according an exemplary embodiment of the instant disclosure.
Figure 2:
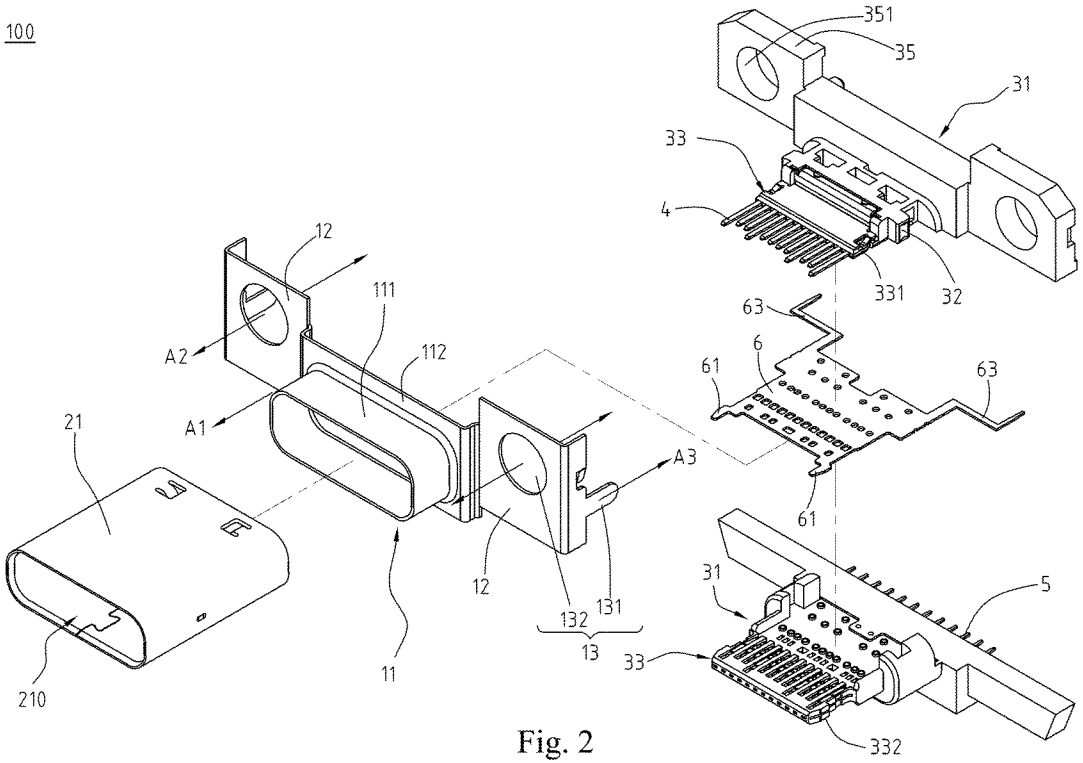
FIG. 2 illustrates an exploded view of the standing-type electrical receptacle connector.
Figure 3:
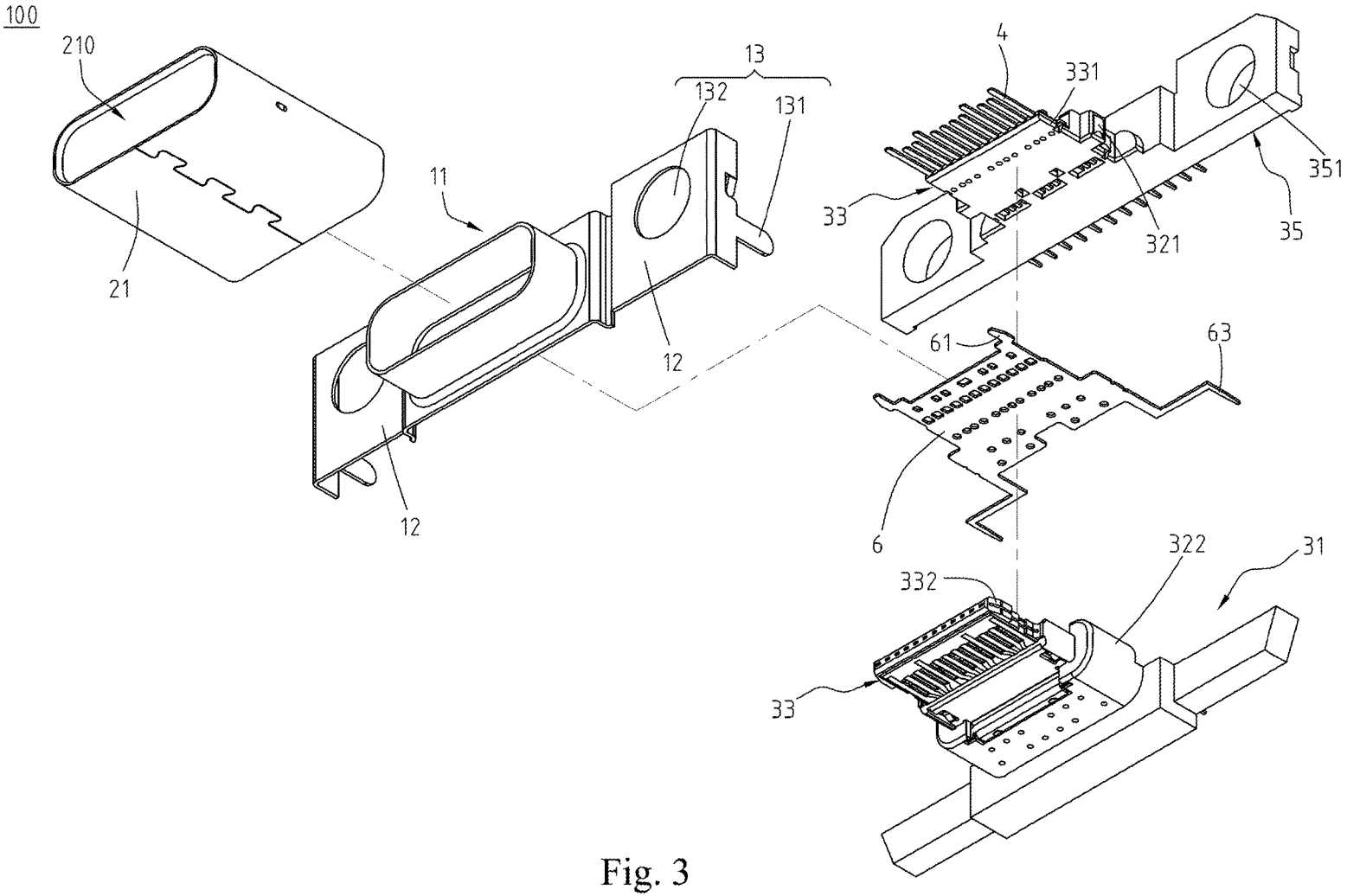
FIG. 3 illustrates an exploded view from the back of the standing-type electrical receptacle connector.
Figure 7:
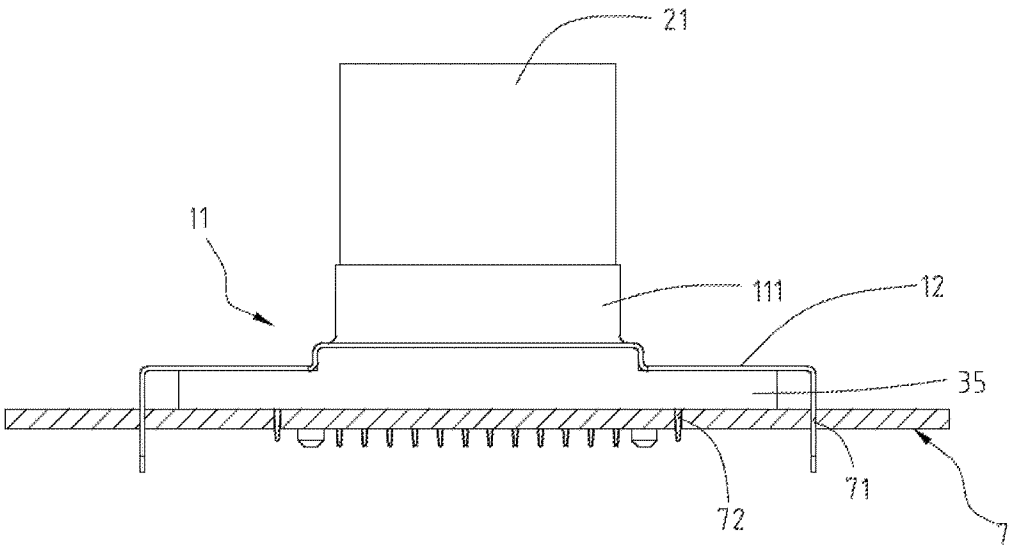
FIG. 7 illustrates a lateral view showing a stood standing-type electrical receptacle connector.

Please refer to FIGS. 1 to 3 and FIG. 7, which illustrate a standing-type electrical receptacle connector 100 of a first embodiment of the instant disclosure. FIG. 1 illustrates a perspective view of a standing-type electrical receptacle connector 100. FIG. 2 illustrates an exploded view of the standing-type electrical receptacle connector 100. FIG. 3 illustrates an exploded from the back of the standing-type electrical receptacle connector 100. FIG. 7 illustrates a lateral view showing a stood standing-type electrical receptacle connector 100.

In this embodiment, the standing-type electrical receptacle connector 100 can provide a reversible or dual orientation USB Type-C connector interface and pin assignments, i.e., a USB Type-C receptacle connector. The standing-type electrical receptacle connector 100 can be utilized in mobile devices, laptop computers, digital cameras, or other electronic devices. In this embodiment, the standing-type electrical receptacle connector 100 comprises an outer shell 11, a metallic shell 21, an insulated housing 31, a plurality of upper-row receptacle terminals 4, and a plurality of lower-row receptacle terminals 5.

In addition, the standing-type electrical receptacle connector 100 further comprises a grounding plate 6 disposed in the insulated housing 31 and located between the upper-row receptacle terminals 4 and the lower-row receptacle terminals 5. The grounding plate 6 comprises a plurality of hook portions 61 and a plurality of pins 63. The hook portions 63 are protruded out of a lateral surface 323 which is between a upper surface 321 and a lower surface 322. Pins 63 of the grounding plate 6 are protruded out of the insulated housing 31 and in contact with a circuit board 7, so that electromagnetic interference (EMI) problems can be improved. In addition, the standing-type electrical receptacle connector 100 may have receptacle terminals aligned in one row. In other words, the standing-type electrical receptacle connector 100 may only have the upper-row receptacle terminals 4 or the lower-row receptacle terminals 5. In this embodiment, the standing-type electrical receptacle connector 100 comprises both the upper-row receptacle terminals 4 and the lower-row receptacle terminals 5, but embodiments are not limited thereto. The standing-type electrical receptacle connector 100 may have receptacle terminals aligned in one row according to practical requirements or cost consideration.

Figure 4:
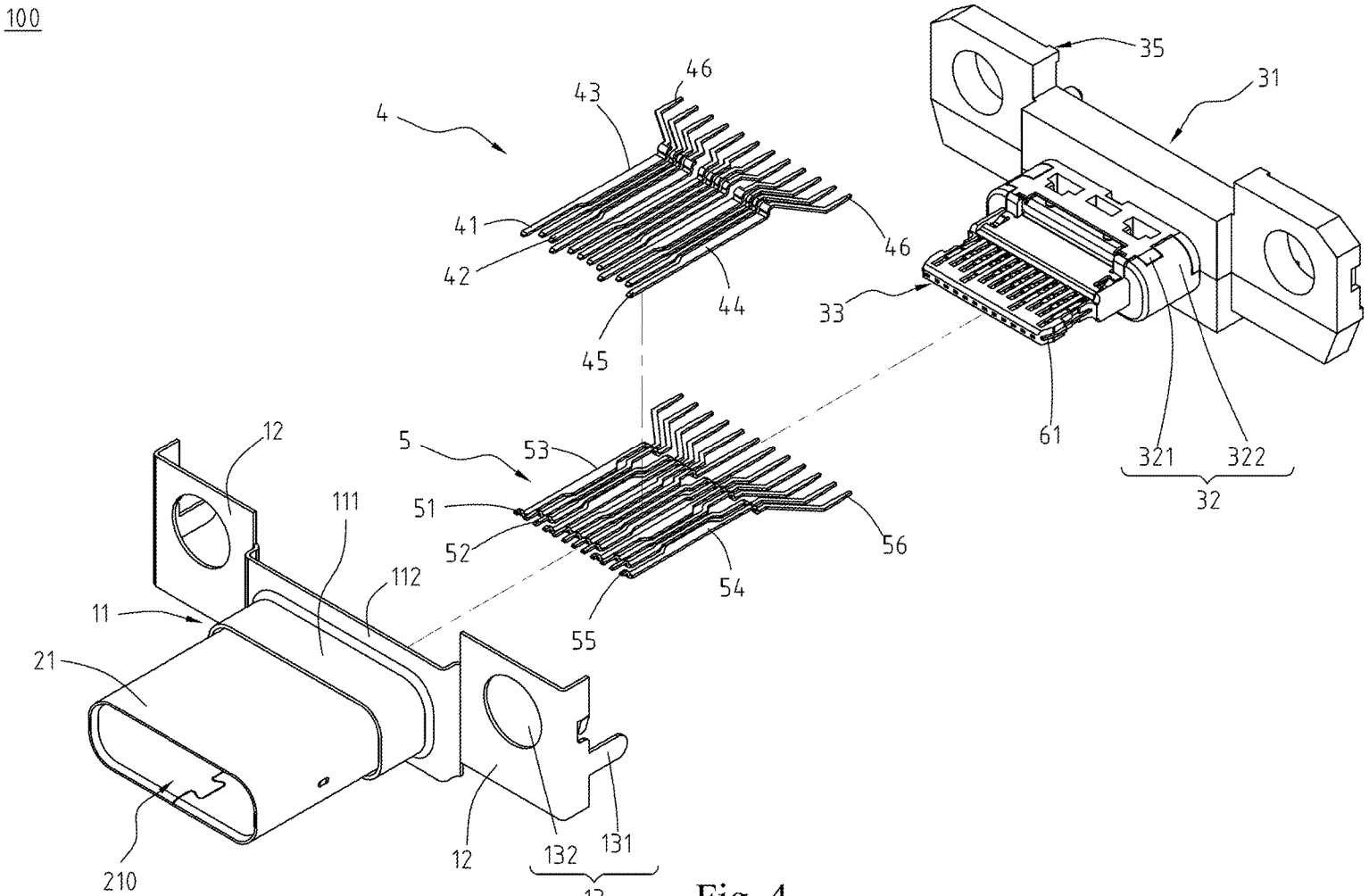
FIG. 4 illustrates an exploded view showing an insulated housing, a plurality of upper-row receptacle terminals, a plurality of lower-row receptacle terminals, and an outer shell of the standing-type electrical receptacle connector.

Please refer to FIGS. 2 to 4. The outer shell 11 is a hollowed shell made of metal and tubular shaped. The outer shell 11 comprises a sleeve 111 and at least two extending sheets 12 integrally formed with the sleeve 111. The sleeve 111 encloses the metallic shell 21. The extending sheets 12 are extending outward from the two sides (i.e., the right side and the left side) of the sleeve 111. In this embodiment, the outer shell 11 comprises two extending sheets 12, but embodiments are not limited thereto. In some embodiments, the outer shell 11 may further comprise two extending sheets 12 extending outward from the top and the bottom of the sleeve 111; alternatively, the outer shell 11 may comprise an extending sheet 12 extending outward from the periphery of the sleeve 111. In this embodiment, the outer shell 11 comprises a covering plate 112 at the rear of the sleeve 111. Each of the extending sheets 12 comprises a positioning portion 13. The positioning portion 13 comprises at least one leg 131 extending outward from the side portion of the covering plate 112, a lock hole 132 formed on the covering plate 112, or the combination thereof. In other words, each of the side portions of the covering plate 112 may comprise a plurality of legs 131 but devoid of any lock hole 132; alternatively, each of the side portions of the covering plate 112 may comprise at least one leg 131 and a lock hole 132.

Figure 8:
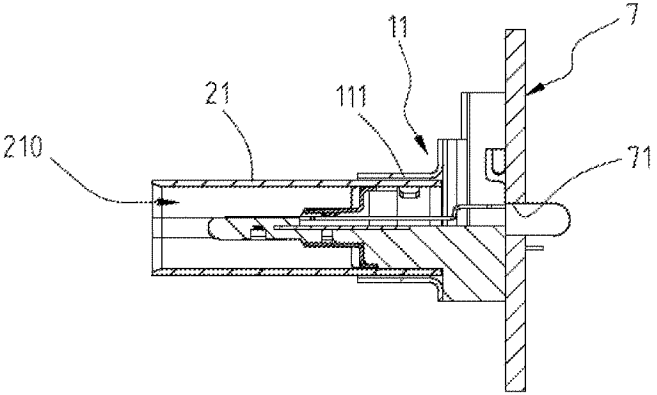
FIG. 8 illustrates a lateral sectional view of the standing-type electrical receptacle connector assembled with a circuit board.

Please refer to FIG. 3, FIG. 4, and FIG. 8. The metallic shell 21 is a hollowed and tubular shell. In this embodiment, the metallic shell 21 may be formed by bending a unitary member. Alternatively, the metallic shell 21 may be formed by deep drawning technique to improve the structural strength. In this embodiment, the metallic shell 21 defines a receiving cavity 210 therein. The outer shell 11 encloses the metallic shell 21; specifically, the outer shell 11 encloses the rear of the metallic shell 21. In addition, the metallic shell 21 encloses the insulated housing 31. Therefore, the metallic shell 21 can be provided for reducing the electromagnetic interference when the upper-row receptacle terminals 4 and the lower-row receptacle terminals 5 are transmitting signals.

Figure 5:
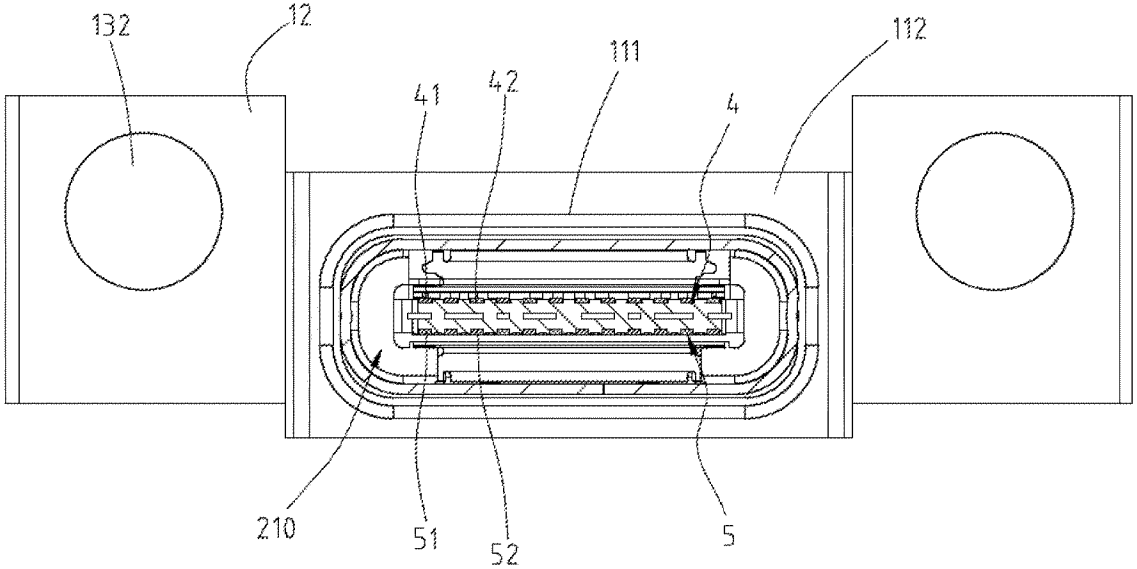
FIG. 5 illustrates a front sectional view of the standing-type electrical receptacle connector.

Please refer to FIG. 4, FIG. 5, and FIG. 8. The insulated housing 31 is received in the receiving cavity 210. In addition, the insulated housing 31 comprises a base portion 32 and a tongue portion 33. In this embodiment, the base portion 32 and the tongue portion 33 are respectively injection molded or the like. Moreover, the base portion 32 and the tongue portion 33 may be formed by a unitary member or a multi-piece member. In this embodiment, an upper base 321 and a lower base 322 are assembled with each other to form the insulated housing 31. In other words, the upper base 321 and the lower base 322 are assembled with each other to form the base portion 32 and the tongue portion 33. The tongue portion 33 is extending from one side of the base portion 32. The tongue portion 33 has an upper surface 331 and a lower surface 332 opposite to the upper surface 331. Moreover, the upper base 321 forms parts of the tongue portion 33 and the upper part of the base portion 32, and the lower base 322 forms the rest parts of the tongue portion 33 and the lower part of the base portion 32. The upper-row receptacle terminals 4 are held in the upper base 321, and the lower-row receptacle terminals 5 are held in the lower base 322.

Please refer to FIG. 4, FIG. 5, and FIG. 8. The base portion 32 is located at a positioned end of the standing-type electrical receptacle connector 100, and the positioned end is provided for being assembled with a circuit board 7. The tongue portion 33 is extending from one side of the base portion 32 toward an inserting end of the standing-type electrical receptacle connector 100, and the inserting end is provided for mating with an electrical plug connector. When the bottom of the base portion 32 is assembled on the circuit board 7, the two extending sheets 12 of the outer shell 11 are abutted against the circuit board 7. In addition, the circuit board 7 comprises positioning holes 71 and contacts 72. The positioning holes 71 are for positioning with the positioning portions 13 of the extending sheets 12. The contacts 72 are for soldering with the upper-row receptacle terminals 4 and the lower-row receptacle terminals 5.

In the case that the positioning portion 13 comprises a leg 131, the leg 131 can be inserted into the positioning hole 71 of the circuit board 7, so that the outer shell 11 can be positioned with the circuit board 7, and the leg 131 can be provided for noise conduction and grounding. In the case that the positioning portion 13 comprises a lock hole 132, a bolt or a threadable component may be applied to pass through the lock hole 132 to lock with the positioning hole 71 of the circuit board 7, so that the outer shell 11 can be positioned with the circuit board 7 firmly. An extending direction A3 of the legs 131 and an extending direction A2 of a central axis of the lock hole 132 are substantially parallel to an extending direction A1 of sleeve 111. In this embodiment, the insulated housing 31 further comprises two extending portions 35 extending outward from two sides of the base portion 32. Each of the extending portions 35 defines a through hole 351, and the through holes 351 correspond to the positioning holes 71 and the lock holes 132. That is, each of the extending portions 35 is between the corresponding extending sheet 12 and the circuit board 7. The bolt or the threadable component passes through the lock hole 132 and the through hole 351 to lock with the positioning hole 71 of the circuit board 7. Therefore, the extending portions 35 allow the standing-type electrical receptacle connector 100 to be stably positioned with the circuit board 7 and improve the structural strength between the standing-type electrical receptacle connector 100 and the circuit board 7. In addition, in some embodiments, the insulated housing 31 may comprise a single extending portion 35 extending outward from one side of the base portion 32. In other words, the extending portion 35 is extending from any one of two sides of the base portion 32, and the single extending portion 35 can also improve the positioning between the connector and the circuit board 7.

Please refer to FIGS. 4 to 6. The upper-row receptacle terminals 4 are held in the base portion 32 and the tongue portion 33. Each of the upper-row receptacle terminals 4 comprises a flat contact portion 45, a body portion 44, and a tail portion 46. For each of the upper-row receptacle terminals 4, the body portion 44 is held in the base portion 32 and disposed at the upper surface 331 of the tongue portion 33, the flat contact portion 45 is extending forward from the body portion 44 in the rear-to-front direction and partly exposed upon the upper surface 331 of the tongue portion 33, and the tail portion 46 is extending backward from the body portion 44 in the front-to-rear direction and protruded from the base portion 32. The upper signal pairs 41 are disposed at the upper surface 331 and transmit first signals (namely, USB 3.0 signals). The tail portions 46 are protruded from the bottom of the base portion 32. In addition, the tail portions 46 may be, but not limited to, extending downwardly to form vertical legs, named through-hole legs, that are inserted into holes drilled in a printed circuit board (PCB) by using through-hole technology. In some embodiments, the tail portions 46 are bent horizontally to form flat legs, named SMT (surface mounted technology) legs, which can be mounted or soldered on the surface of a printed circuit board by using surface mount technology.

Please refer to FIGS. 4 to 6. The lower-row receptacle terminals 5 are held in the base portion 32 and the tongue portion 33. The lower-row receptacle terminals 5 are spacedly aligned below the upper-row receptacle terminals 4. Each of the lower-row receptacle terminals 5 comprises a flat contact portion 55, a body portion 54, and a tail portion 56. For each of the lower-row receptacle terminals 5, the body portion 54 is held in the base portion 32 and disposed at the lower surface 332 of the tongue portion 33, the flat contact portion 55 is extending from the body portion 54 in the rear-to-front direction and partly exposed upon the lower surface 332 of the tongue portion 33, and the tail portion 56 is extending backward from the body portion 54 in the front-to-rear direction and protruded from the base portion 32. The lower signal pairs 51 are disposed at the lower surface 332 and provided for transmitting second signals (i.e., USB 3.0 signals). The tail portions 56 are protruded from the bottom of the base portion 32. In addition, the tail portions 56 may be, but not limited to, extending downwardly to form vertical legs, named through-hole legs, that are inserted into holes drilled in a printed circuit board by using through-hole technology. In some embodiments, the tail portions 56 are bent horizontally to form flat legs, named SMT legs, which can be mounted or soldered on the surface of a printed circuit board by using surface mount technology. In this embodiment, the tail portions 46, 56 are protruded out of the base portion 32 and arranged separately. For example, the tail portions 46, 56 may form two rows. Accordingly, the soldering between the tail portions 46, 56 and the circuit board 7 may also improve the positioning between the standing-type electrical receptacle connector 100 and the circuit board 7.

Please refer to FIGS. 4 to 6. In this embodiment, the upper-row receptacle terminals 4 comprise a plurality of upper signal pairs 41, at least one power terminal 42, and at least one ground terminal 43. Referring to FIG. 6, the upper-row receptacle terminals 4 comprise, from left to right, a ground terminal 43 (Gnd), a first upper signal pairs (TX1+−) 41, a second upper signal pairs (D+−) 41, and a third upper signal pairs (RX2+−) 41, two power terminals 42 (Power/VBUS) between the three pairs of upper signal pairs 41, a retain terminal (RFU) and another ground terminal 43 (Gnd) at the rightmost. However, the pin assignments are not thus limited, and the example described here is only for illustrative purposes. In this embodiment, twelve upper-row receptacle terminals 4 are provided for transmitting USB 3.0 signals, but embodiments are not limited thereto. In some embodiments, the rightmost ground terminal 43 (or the leftmost ground terminal 43) and the retain terminal are omitted. Furthermore, the rightmost ground terminal 43 may be replaced by a power terminal 42 and provided for power transmission.

Please refer to FIGS. 4 to 6. In this embodiment, the lower-row receptacle terminals 5 comprise a plurality of lower signal pairs 51, at least one power terminal 52, and at least one ground terminal 53. Referring to FIG. 6, the lower-row receptacle terminals 5 comprise, from right to left, a ground terminal 53 (Gnd), a first lower signal pair (TX2+−) 51, a second lower signal pairs (D+−) 51, and a third lower signal pairs (RX1+−) 51, two power terminals 52 (Power/VBUS) between the three lower signal pairs 51, a retain terminal (RFU) and another ground terminal 53 (Gnd) at the leftmost. However, the pin assignments are not thus limited, and the example described here is only for illustrative purposes. In this embodiment, twelve lower-row receptacle terminals 5 are provided for transmitting USB 3.0 signals, but embodiments are not limited thereto. In some embodiments, the rightmost ground terminal 53 (or the leftmost ground terminal 53) and the retain terminal are omitted. Furthermore, the rightmost ground terminal 53 may be replaced by a power terminal 52 and provided for power transmission.

In the forgoing embodiments, the receptacle terminals 4, 5 are provided for transmitting USB 3.0 signals, but embodiments are not limited thereto. In some embodiments, for the upper-row receptacle terminals 4 in accordance with transmission of USB 2.0 signals, the first upper signal pairs (TX1+−) 41 and the third upper signal pairs (RX2+−) 41 are omitted, and the second upper signal pairs (D+−) 41 and the power terminals (Power/VBUS) 42 are retained. While for the lower-row receptacle terminals 5 in accordance with transmission of USB 2.0 signals, the first lower signal pairs (TX2+−) 51 and the third lower signal pairs (RX1+−) 51 are omitted, and the second lower signal pairs (D+−) 51 and the power terminals (Power/VBUS) 52 are retained.

Please refer to FIGS. 4 to 6. In this embodiment, the upper-row receptacle terminals 4 and the lower-row receptacle terminals 5 are respectively disposed at the upper surface 331 and the lower surface 332 of the tongue portion 33. In this embodiment, as shown in FIG. 5 and FIG. 6, the position of the upper-row receptacle terminals 4 corresponds to the position of the lower-row receptacle terminals 5. Additionally, pin-assignments of the upper-row receptacle terminals 4 and the lower-row receptacle terminals 5 are point-symmetrical with a central point of the receiving cavity 210 as the symmetrical center. In other words, pin-assignments of the upper-row receptacle terminals 4 and the lower-row receptacle terminals 5 have 180 degree symmetrical design with respect to the central point of the receiving cavity 210 as the symmetrical center. The dual or double orientation design enables an electrical plug connector to be inserted into the standing-type electrical receptacle connector 100 in either of two intuitive orientations, i.e., in either upside-up or upside-down directions. Here, point-symmetry means that after the upper-row receptacle terminals 4 (or the lower-row receptacle terminals 5), are rotated by 180 degrees with the symmetrical center as the rotating center, the upper-row receptacle terminals 4 and the lower-row receptacle terminals 5 are overlapped. That is, the rotated upper-row receptacle terminals 4 are arranged at the position of the original lower-row receptacle terminals 5, and the rotated lower-row receptacle terminals 5 are arranged at the position of the original upper-row receptacle terminals 4. In other words, the upper-row receptacle terminals 4 and the lower-row receptacle terminals 5 are arranged upside down, and the pin assignments of the flat contact portions 45 are left-right reversal with respect to that of the flat contact portions 55. An electrical plug connector is inserted into the standing-type electrical receptacle connector 100 with a first orientation where the upper surface 331 is facing up, for transmitting first signals. Conversely, the electrical plug connector is inserted into the standing-type electrical receptacle connector 100 with a second orientation where the upper surface 331 is facing down, for transmitting second signals. Furthermore, the specification for transmitting the first signals is conformed to the specification for transmitting the second signals. Note that, the inserting orientation of the electrical plug connector is not limited by the standing-type electrical receptacle connector 100 according embodiments of the instant disclosure.

Based on the above, the outer shell is fitted over the metallic shell and comprises two extending sheets extending therefrom for improving the positioning stability between the standing-type electrical receptacle connector and the circuit board, by the way that the two extending sheets allow the standing-type electrical receptacle connector to be firmly positioned with the circuit board after the standing-type electrical receptacle connector is soldered with the circuit board. In addition, the extending sheet comprises a positioning portion corresponding to the positioning hole of the circuit board. The positioning portion may be a leg inserted into the positioning hole or may be a lock hole allowing a bolt or a threadable component to pass through and to further lock with the positioning hole of the circuit board. Hence, the standing-type electrical receptacle connector can be stably positioned with the circuit board, and the overall structural strength between the connector and the circuit board can be improved. In addition, because the metallic shell and the outer shell are separate pieces, the manufacturing of the connector can be simplified and the overall strength of the connector can be improved.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the standing-type electrical receptacle connector can have a 180 degree symmetrical, dual or double orientation design and pin assignments which enables the standing-type electrical receptacle connector to be mated with a corresponding plug connector in either of two intuitive orientations, i.e. in either upside-up or upside-down directions. Therefore, when an electrical plug connector is inserted into the standing-type electrical receptacle connector with a first orientation, the flat contact portions of the upper-row receptacle terminals are in contact with upper-row plug terminals of the electrical plug connector. Conversely, when the electrical plug connector is inserted into the standing-type electrical receptacle connector with a second orientation, the flat contact portions of the lower-row receptacle terminals are in contact with the upper-row plug terminals of the electrical plug connector. Note that, the inserting orientation of the electrical plug connector is not limited by the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell defining a receiving cavity therein;

an insulated housing received in the receiving cavity, wherein the insulated housing comprises a base portion and a tongue portion extending from one side of the base portion, wherein the tongue portion has an upper surface and a lower surface, and the upper surface is opposite to the lower surface;

a plurality of upper-row receptacle terminals, wherein each of the upper-row receptacle terminals is held in the insulated housing and disposed at the upper surface; and a plurality of lower-row receptacle terminals, wherein each of the lower-row receptacle terminals is held in the insulated housing and disposed at the lower surface; and an outer shell comprising a sleeve enclosing the metallic shell, at least two extending sheets respectively extending from two sides of the sleeve, a covering plate at the rear of the sleeve to cover the base portion, and at least two positioning portions at the respective extending sheets, wherein each of the positioning portions further comprises a lock hole formed on the covering plate, wherein an extending direction of a central axis of the lock hole is substantially parallel to an extending direction of the sleeve.

2. The electrical receptacle connector according to claim 1, wherein the insulated housing comprises an upper base and a lower base, the upper base and the lower base are extending out of the metallic shell, and wherein the covering plate at the rear covers the upper base and the lower base.

3. The electrical receptacle connector according to claim 1, wherein each of the positioning portions further comprises at least one leg extending outward from the side portion of the covering plate, each of the positioning portions comprises at least one leg extending outward from the side portion of the covering plate and an extending direction of the at least one leg is substantially parallel to an extending direction of the sleeve.

4. The electrical receptacle connector according to claim 1, further comprising a circuit board assembled on the base portion, wherein each of the extending sheets is abutted against the circuit board, and wherein the circuit board comprises at least two positioning holes, the positioning holes are respectively positioned with the positioning portions.

5. The electrical receptacle connector according to claim 4, wherein the insulated housing comprises at least one extending portion extending outward from one side of the base portion, and the extending portion defines a through hole corresponding one of the positioning holes.

6. The electrical receptacle connector according to claim 1, wherein the upper-row receptacle terminals and the lower-row receptacle terminals have 180 degree symmetrical design with respect to a central point of the receiving cavity as the symmetrical center.

7. The electrical receptacle connector according to claim 1, wherein the position of the upper-row receptacle terminals corresponds to the position of the lower-row receptacle terminals.

8. The electrical receptacle connector according to claim 1, wherein each of the upper-row receptacle terminals comprises a flat contact portion, a body portion, and a tail portion, wherein the body portion is held in the base portion and disposed at the upper surface of the tongue portion, the flat contact portion is extending forward from the body portion in the rear-to-front direction and partly exposed upon the upper surface of the tongue portion, and the tail portion is extending backward from the body portion in the front-to-rear direction and protruded from the base portion.

9. The electrical receptacle connector according to claim 1, wherein each of the lower-row receptacle terminals comprises a flat contact portion, a body portion, and a tail portion, wherein the body portion is held in the base portion and disposed at the lower surface of the tongue portion, the flat contact portion is extending forward from the body portion in the rear-to-front direction and partly exposed upon the lower surface of the tongue portion, and the tail portion is extending backward from the body portion in the front-to-rear direction and protruded from the base portion.

10. The electrical receptacle connector according to claim 1, further comprising a grounding plate disposed at the insulated housing and between the upper-row receptacle terminals and the lower-row receptacle terminals, wherein the grounding plate comprises a hook portion and a pin, wherein the hook portion is at one side of the grounding plate and protrudes out a lateral surface which is between the upper surface and the lower surface, and the pin is at another side of the grounding plate and protrudes out the base portion.

11. The electrical receptacle connector according to claim 1, wherein the insulated housing comprises at least one extending portion extending outward from one side of the base portion, and the extending portion defines a through hole corresponding to the lock holes.

12. The electrical receptacle connector according to claim 1, wherein the plurality of upper-row receptacle terminals comprises a plurality of upper signal pairs, at least one power terminal, and at least one ground terminal.

13. The electrical receptacle connector according to claim 1, wherein the plurality of lower-row receptacle terminals comprises a plurality of lower signal pairs, at least one power terminal, and at least one ground terminal.

14. The electrical receptacle connector according to claim 1, wherein the electrical receptacle connector is a standing-type electrical receptacle connector.

* * * * *